US006668938B2

(12) United States Patent
Sheffield et al.

(10) Patent No.: US 6,668,938 B2
(45) Date of Patent: Dec. 30, 2003

(54) CUP PACKER

(75) Inventors: Randolph J. Sheffield, Missouri City, TX (US); David M. Eslinger, Broken Arrow, OK (US); Mark C. Oettli, Richmond, TX (US); Jose F. Hurtado, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/098,121

(22) Filed: Mar. 13, 2002

(65) Prior Publication Data

US 2002/0139541 A1 Oct. 3, 2002

Related U.S. Application Data

(60) Provisional application No. 60/280,057, filed on Mar. 30, 2001.

(51) Int. Cl.[7] ..... E21B 33/128

(52) U.S. Cl. ..... 166/387; 166/202; 277/335

(58) Field of Search ..... 166/378, 202, 166/121, 153, 199, 201, 387; 277/335, 626

(56) References Cited

U.S. PATENT DOCUMENTS 2,702,220 A 2/1955 Johnson
2,870,794 A * 1/1959 Thaxton ..... 138/90
4,373,063 A * 2/1983 Sakano et al. ..... 525/64
4,702,481 A * 10/1987 Brammer ..... 277/328
5,409,061 A 4/1995 Bullick
6,315,041 B1 11/2001 Carlisle et al.

FOREIGN PATENT DOCUMENTS

WO WO 98/41811 9/1998

OTHER PUBLICATIONS

"Packer Cups" MP Industries, Inc., Mar. 7, 2002, World–Wide Web (www.mpioiltool.com/packercups.html), 2 pages.

"Well Servicing and Production Equipment", Packer Cups, Oil States Industries, Inc., pp. 10–12, undated.

* cited by examiner

*Primary Examiner*—David Bagnell
*Assistant Examiner*—Matthew J Smith
(74) *Attorney, Agent, or Firm*—Wayne I. Kanak; Robin Nava; Brigitte L. Jeffery

(57) ABSTRACT

An improved cup packer for use on wellbore tools is disclosed. The open end of the cup packer bore is filled with an elastomer to prevent the intrusion of sand and debris into the space between the cup packer and the wellbore tool on which it is mounted. In an alternative embodiment of the invention, the packer body includes an angularly protruding section at at least one of its ends, wherein the longitudinal dimension of the packer body is at its maximum at its bore. In an additional alternative embodiment of the invention, the open end of the packer is sealed by a screen to prevent the intrusion of sand and debris into the space between the cup packer and the wellbore tool on which it is mounted.

21 Claims, 4 Drawing Sheets

CUP PACKER

CROSS-REFERENCE TO RELATED APPLICATIONS

This application claims priority from U.S. Provisional Application No. 60/280,057 filed on Mar. 30, 2001, which is incorporated herein by reference.

BACKGROUND OF THE INVENTION

1. Field of the Invention

This invention relates generally to cup packers for use in wellbore tools and, more specifically, formation interval straddle tools that are employed for earth formation zone fracturing or other formation treating operations in wellbores. More particularly, the invention relates to improved cup packers which resist the intrusion of sand and debris into their open end.

2. Description of Related Art

Cup packers used on formation interval straddle tools and other wellbore tools for oilfield applications are generally formed of hardened rubber materials and are of an open-ended design. During formation fracturing or treating operations when pressurized fracturing or treating fluids are pumped through the straddle tool to the formation zone to be fractured or treated, the open ends of such cup packers fill with the treating fluid which often has sand and debris entrained therein. If a "screenout", during which sand is left within the straddled interval of the wellbore following treatment, occurs, the fluid within the straddled interval can become dehydrated forming a dense sand pack between the cup packers and within the open ends of the cup packers. The mechanical wedging of sand between the cup packers can result in high pulling forces during retrieval of the straddle tool following treatment of the formation. Additionally, sand wedged within the open ends of the cup packers may impair their ability to properly seal the interval straddled between the upper and lower packers of the straddle tool to sustain the necessary differential pressure during subsequent treatments of the formation.

Therefore, there is a need for an improved cup packer that resists the intrusion of sand and debris into its open end.

BRIEF SUMMARY OF THE INVENTION

It is a principal feature of the present invention to provide a cup packer for use in wellbore tools and, more specifically, formation interval straddle tools, that resists the intrusion of sand and debris into its open end and thereby improves the operational characteristics and pressure-sealing performance of the wellbore tool.

Briefly, the invention is a cup packer wherein the open end is sealed or screened to prevent sand and debris intrusion therein.

BRIEF DESCRIPTION OF THE DRAWINGS

So that the manner in which the above recited features, advantages and objects of the present invention are attained may be understood in detail, a more particular description of the invention, briefly summarized above, may be had by reference to the preferred embodiments thereof illustrated in the appended drawings.

DETAILED DESCRIPTION OF THE INVENTION

Figure 1:
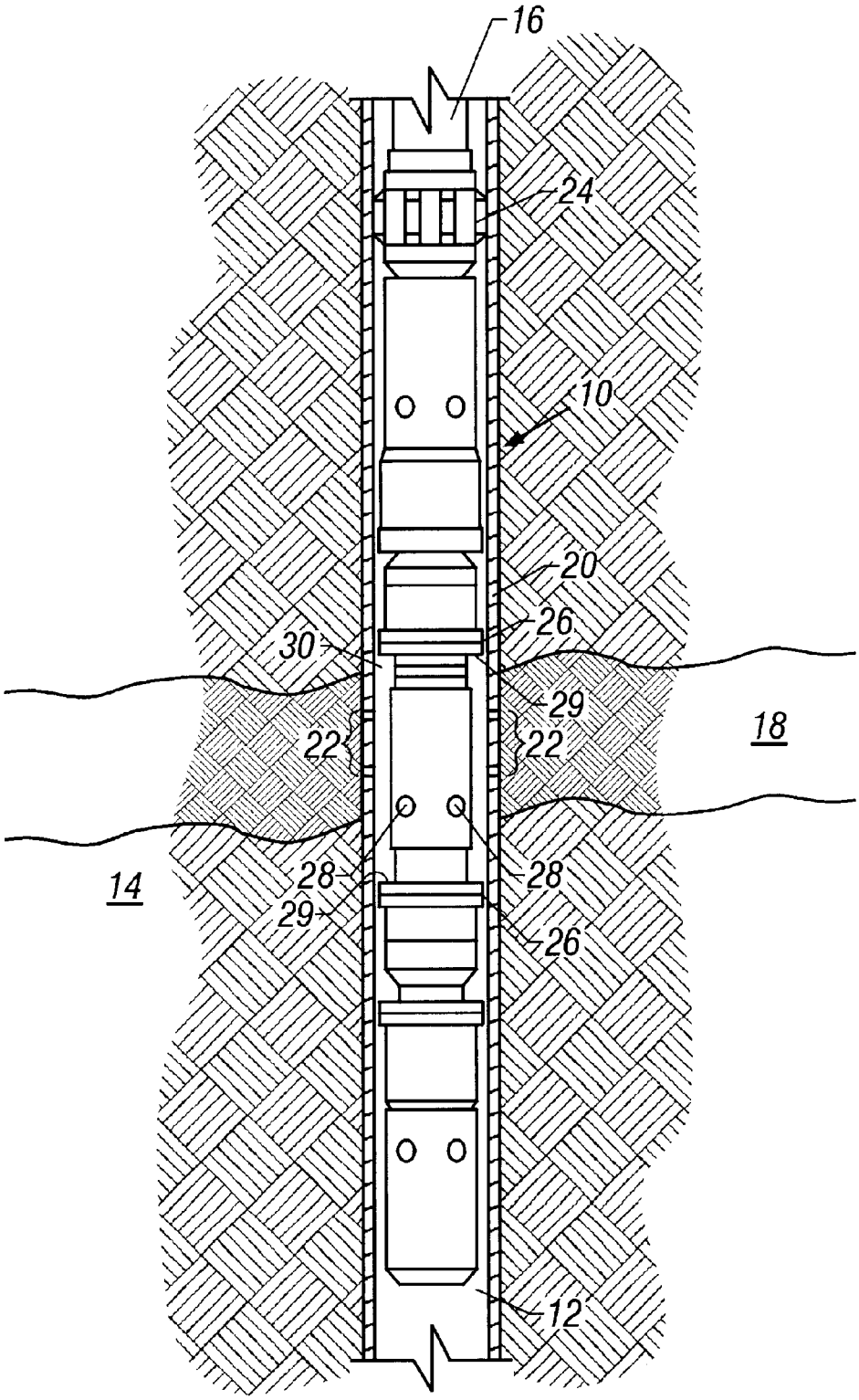
FIG. 1 is a schematic representation of a formation interval straddle tool employed for earth formation zone fracturing or other formation treating operations deployed in a wellbore.

Referring now to FIG. 1, a formation interval straddle tool 10 of the type typically employed for earth formation zone fracturing or other formation treating operations in wellbores is shown positioned within a cased wellbore 12 which has been drilled in an earth formation 14. The straddle tool 10 may be lowered into the wellbore 12 on a string of coiled or jointed tubing 16 to a position adjacent a selected zone 18 of the earth formation 14. If the wellbore 12 has been cased with a casing 20, the casing 20 will have been perforated at the selected zone 18 by the firing of the perforating shaped charges of a perforating gun or other perforating device, as illustrated by the perforations 22, prior to the deployment of the straddle tool 10.

Once the straddle tool 10 is in position adjacent the selected formation zone 18, the straddle tool 10 is operated from the earth's surface to deploy anchor slips 24 to lock itself firmly into the casing 20 in preparation for fracturing or treating the selected formation zone 18. The straddle tool 10 comprises one or more cup packers 26 which, when pressurized fracturing or treating fluid is pumped from the earth's surface through the string of coiled or jointed tubing 16 to the straddle tool 10, are forced to engage the casing 20 by the pressure of fluid exiting the straddle tool 10 at one or more treating ports 28. The open ends 29 of the cup packers 26 are arranged to face each other and the straddled interval 30 of the wellbore 12 between the cup packers.

When the cup packers 26 have fully engaged the casing 20, the formation zone 18 and the straddled interval 30 between the cup packers 26 will be pressurized by the incoming fracturing or treating fluid. Upon completion of fracturing or treating of the formation zone 18, the pumping of fracturing or treating fluid from the earth's surface is discontinued, and the straddle tool 10 is operated to dump any excess fluid, thereby relieving the pressure in the straddled interval 30.

Figure 2:
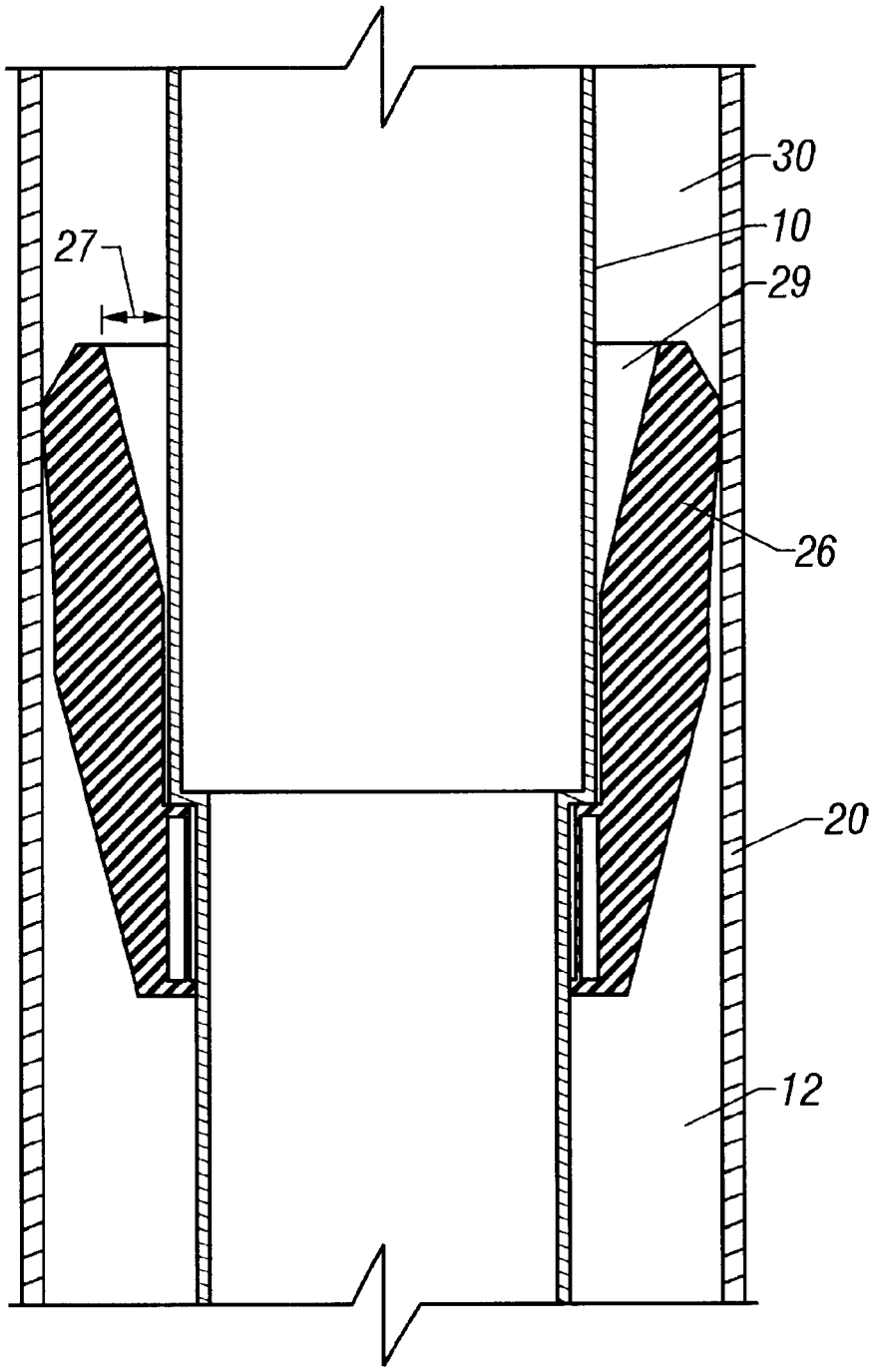
FIG. 2 (Prior Art)
FIG. 2 is a longitudinal sectional view of a cup packer of a typical prior art design mounted on a formation interval straddle tool deployed in a wellbore.

Referring to FIG. 2, a straddle cup packer 26 of a typical prior art design is illustrated in cross-section mounted on a straddle tool 10. The cup packer 26, having a body generally formed of a hardened rubber material, is shown in engagement with a casing 20 in a wellbore 12 such as would occur with the straddled interval 30 of the wellbore 12 under pressure from fracturing or treating fluid. As previously noted, the open end 29 of the cup packer 26 is arranged to face the straddled interval 30 between the cup packers mounted on the straddle tool 10. On its open end 29 the bore of the cup packer 26 gradually enlarges thereby forming a gap 27 between the cup packer 26 and the wall of the straddle tool 10. As the treating fluid often has sand and debris entrained therein, the open end 29 tends to collect such sand and debris when the straddled interval 30 is depressurized.

If a "screenout", during which sand is left within the straddled interval 30 following treatment, occurs, the fluid within the straddled interval 30 can become dehydrated forming a dense sand pack between the cup packers 26 and within the open ends 29 of the cup packers. The mechanical wedging of sand between the cup packers 26 can result in high pulling forces during retrieval of the straddle tool 10 following treatment of the formation. Additionally, sand wedged within the open ends 29 of the cup packers 26 may impair the ability of the packers to properly seal the straddled interval 30 to sustain the necessary differential pressure during the subsequent treatment of another formation zone. Cup packers in accordance with the present invention alleviate the aforementioned problems as they prevent the accumulation of sand and debris in their open ends.

Figure 3:
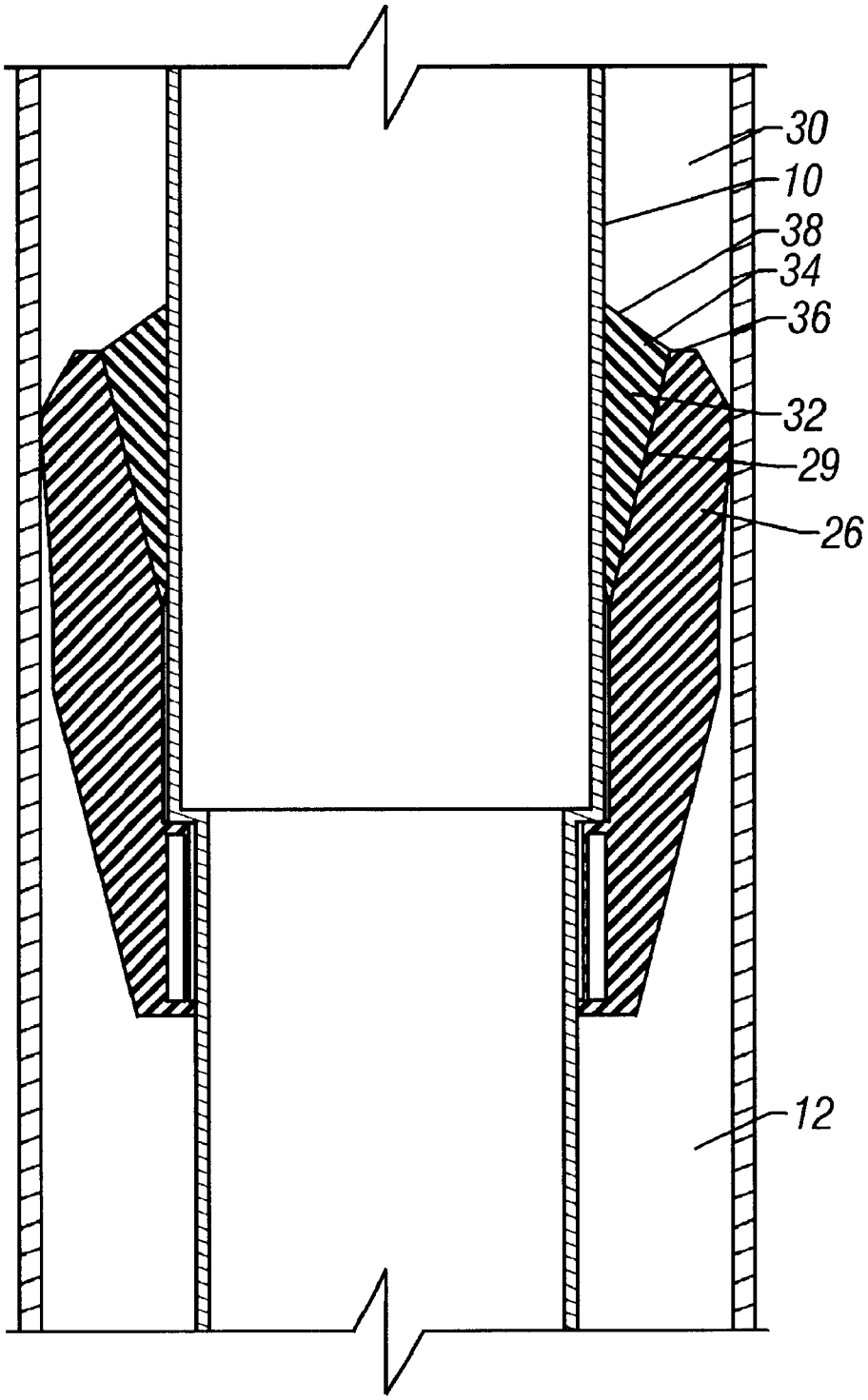
FIG. 3 is a longitudinal sectional view of a cup packer in accordance with a first embodiment of the present invention mounted on a formation interval straddle tool deployed in a wellbore.

FIG. 3 is a longitudinal sectional view of a cup packer 26 in accordance with a first embodiment of the present invention mounted on a formation interval straddle tool 10 deployed in a wellbore 12. The open end 29 of the cup packer 26 is filled with an elastomer filler 32. The elastomer filler 32 may be added to a standard commercial cup packer after manufacture, or it may be integrally and seamlessly molded into the cup packer 26 during manufacture. In either case, the elastomer filler 32 fills the open end 29 of the packer bore such that the cross-sectional dimension of the filled bore is substantially the same as that of the straddle tool 10, thereby effectively eliminating the possibility that the cup packer 26 may retain any sand or debris entrained in the fracturing or treating fluid. The term "substantially the same" as used herein means having a dimension allowing for normal fitting tolerances between components.

The longitudinal dimension of the packer, defined as the top of protruding section 34 to the bottom of packer 26, is at its maximum at the bore.

The elastomer filler 32 is preferably formed of the same material as the cup packer 26, for example 80A or 90A durometer nitrile butyl rubber ("NBR") or hydrogenated nitrile butyl rubber ("HNBR"). Other materials, such as low durometer elastomers, for example 60A durometer NBR, are equally suitable for elastomer fillers 32 added to standard commercial cup packers after manufacture.

The configuration of the elastomer filler 32 in the embodiment of the invention illustrated in FIG. 3 provides for enhanced effectiveness of sealing between the cup packer 26 and the tool 10 on which it is mounted when treating fluid pressure is applied in the straddled interval 30. The elastomer filler 32 has a section 34 which angularly protudes from the end surface 36 of the cup packer 26. The pressure of treating fluid in the straddled interval 30 acting on the surface 38 of section 34 of the elastomer filler 32 forces the elastomer filler 32 into sealing contact with the surface of the tool 10 thereby minimizing the intrusion of sand and debris between the surface of the tool 10 and the cup packer 26. Alternatively, where the elastomer filler 32 is integrally and seamlessly molded into the cup packer 26 at the time of manufacture, it may be advantageous to entirely eliminate the end surface 36 such that the angularly protruding section 34 extends to the outermost surface of the cup packer 26.

Figure 4:
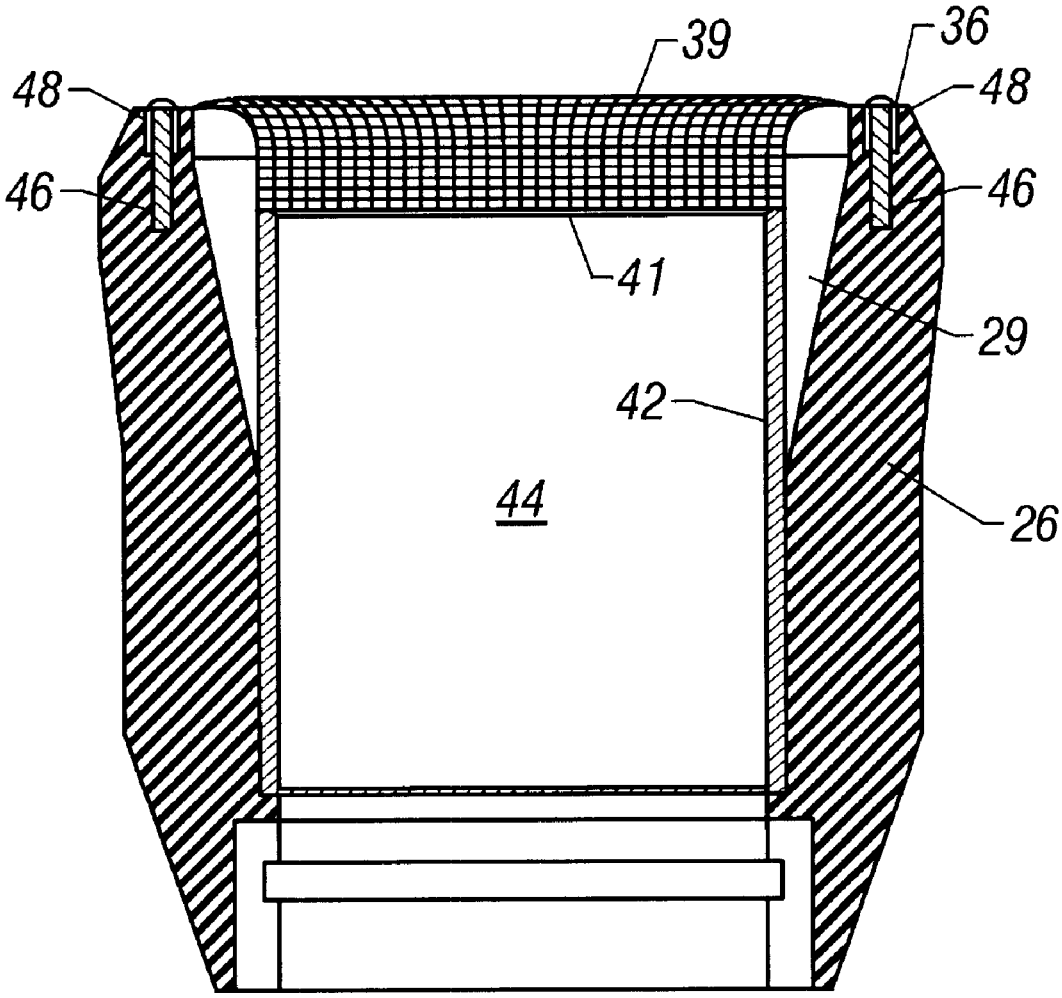
FIG. 4 is a longitudinal sectional view of a cup packer in accordance with a second embodiment of the present invention.

FIG. 4 is a longitudinal sectional view of a cup packer 26 in accordance with a second embodiment of the present invention. A screen 39 is mounted in the open end 29 of the cup packer 26 and acts to prevent the intrusion of sand and debris therein. The inner end 41 of the screen 39 is sealingly attached to a screen sleeve 42 by welding or other suitable means. The screen assembly comprising the screen 39 and screen sleeve 42 is then mounted in the bore 44 of the cup packer 26 and sealingly secured to the end surface 36 of the cup packer 26 by screws 46 driven into threaded inserts 48 which may be molded into the cup packer 26 at the time of manufacture or inserted after manufacture of the cup packer 26. Alternatively, the screen 39 may be integrally molded into the cup packer 26, with or without a screen sleeve 42. The screen sleeve 42 may also be integrally molded into the cup packer 26. If a screen sleeve is not used, the screen 39 may be attached to the cup packer 26 only at open end 29 and need not be attached within the bore 44.

The screen 39 may be made of any suitable material and the mesh size may be selected according to the expected size of the sand and debris particles to be excluded from the open end 29 of the cup packer 26. A 40 mesh screen formed of 0.010 inch diameter 304 stainless steel wire has been found to be satisfactory for many applications.

The particular embodiments disclosed above are illustrative only, as the invention may be modified and practiced in different but equivalent manners apparent to those skilled in the art having the benefit of the teachings herein. Furthermore, no limitations are intended to the details of construction or design shown herein, other than as described in the claims below. It is therefore evident that the particular embodiments disclosed above may be altered or modified and all such variations are considered within the scope and spirit of the invention.

What is claimed is:

1. A cup packer for mounting on a wellbore tool, comprising:

a packer body having first and second ends and having a longitudinal bore therethrough;

wherein said bore at at least one of said ends is of a larger cross-sectional dimension than said wellbore tool at the location of said end when said cup packer is mounted on said wellbore tool; and wherein at said at least one end said bore is filled with a filler material such that said filled bore is of substantially the same cross-sectional dimension as said wellbore tool at said location.

2. The cup packer of claim 1, wherein said filler material is an elastomer.

3. The cup packer of claim 2, wherein said elastomer is selected from the group comprising nitrile butyl rubber having a hardness of 60A, 80A, or 90A durometer, and hydrogenated nitrile butyl rubber having a hardness of 80A or 90A.

4. The cup packer of claim 2, wherein said elastomer is the same material as that of said cup packer.

5. The cup packer of claim 1, wherein said filler material forms an angularly protruding section such that the longitudinal dimension of said packer body is at its maximum at said bore.

6. A cup packer for use on a wellbore tool, comprising:

a packer body having first and second ends and having a longitudinal bore therethrough;

said packer body having an angularly protruding section at at least one of said ends, wherein the longitudinal dimension of said packer body is at its maximum at said bore.

7. The cup packer of claim 6, wherein said packer body is formed of an elastomer selected from the group comprising nitrile butyl rubber having a hardness of 80A, or 90A durometer, and hydrogenated nitrile butyl rubber having a hardness of 80A or 90A durometer.

8. A cup packer for use on a wellbore tool, comprising:

a packer body having first and second ends and having a longitudinal bore therethrough, wherein the cross-sectional dimension of said bore is larger than its minimum cross-sectional dimension at at least one of said ends; and a screen sealingly secured to said packer body at said at least one end.

9. The cup packer of claim 8, wherein said screen is sealingly secured within said bore.

10. The cup packer of claim 8, wherein said screen is attached to said at least one end by screws.

11. The cup packer of claim 8, wherein said screen is integrally molded into said packer body.

12. The cup packer of claim 8, wherein said screen is formed of wire mesh.

13. The cup packer of claim 11, wherein said wire mesh is stainless steel.

14. The cup packer of claim 9, further comprising:

a sleeve within said bore; and wherein said screen is sealingly secured to said sleeve.

15. The cup packer of claim 14, wherein said screen is attached to said sleeve by welding.

16. The cup packer of claim 14, wherein said screen is integrally molded into said packer body.

17. The cup packer of claim 14, wherein said sleeve is integrally molded into said packer body.

18. A method of preventing the intrusion of sand and debris into the open end of a cup packer mounted on a wellbore tool, said cup packer having a longitudinal bore therein, the method comprising:

filling said bore at said open end with an elastomer such that the cross-sectional dimension of said filled bore is substantially the same as that of said wellbore tool at the location of said filled bore when said cup packer is mounted on said wellbore tool, wherein said elastomer forms an angularly protruding section such that the longitudinal dimension of said cup packer is at its maximum at said bore.

19. A method of preventing the intrusion of sand and debris into the open end of a cup packer for use on a wellbore tool, said cup packer comprising a packer body having a longitudinal bore therethrough, the method comprising:

sealingly securing a screen to said packer body around the periphery of said open end.

20. The method of claim 19, further comprising sealingly securing said screen to said packer body within said bore.

21. The method of claim 19, further comprising integrally molding said screen into said packer body.

* * * * *